United States Patent [19]

Inger

[11] Patent Number: 4,494,370

[45] Date of Patent: Jan. 22, 1985

[54] STOP MOTION FOR TEXTILE MACHINES

[75] Inventor: Siegfried Inger, Krefeld, Fed. Rep. of Germany

[73] Assignee: Palitex Project-Company GmbH, Dusseldorf, Fed. Rep. of Germany

[21] Appl. No.: 457,884

[22] Filed: Jan. 14, 1983

[30] Foreign Application Priority Data

Jan. 21, 1982 [DE] Fed. Rep. of Germany ..... 3201694

[51] Int. Cl.[3] ..... D01H 13/16

[52] U.S. Cl. ..... 57/81; 57/80

[58] Field of Search ..... 57/78, 80, 81, 83, 84, 57/86, 87; 200/61.13, 61.18

[56] References Cited

U.S. PATENT DOCUMENTS 3,701,247 10/1972 Rehn et al. ..... 57/81

4,254,613 3/1981 Arita et al. ..... 57/81

*Primary Examiner*—John Petrakes

*Attorney, Agent, or Firm*—Bell, Seltzer, Park and Gibson

[57] ABSTRACT

A stop motion for textile machines for transmitting a signal for stopping a working station in case of a thread breakage or a used-up supply bobbin. The stop motion includes a thread guide eyelet secured to a thread sensor bar which is pivotable about a horizontal pivot shaft, and is characterized by a guide element located between the pivot shaft and the thread guide eyelet. The guide element supports the thread sensor bar in its normal operating position against lateral vibrational movements exerted by the running thread.

11 Claims, 4 Drawing Figures

STOP MOTION FOR TEXTILE MACHINES

FIELD OF THE INVENTION

The invention relates to a stop motion mechanism for textile machines for transmitting a signal for stopping a working station in case of a thread breakage or a used-up supply bobbin or otherwise exhausted thread and of the kind which includes a thread guide eyelet secured to a thread sensor bar which is pivotable about a horizontal pivot shaft.

BACKGROUND OF THE INVENTION

The usual stop motions of this kind (see e.g. German OS No. 20 24 122) have a relatively long thread sensor bar and, thus, a relatively long distance between the pivot shaft and the thread guide eyelet so that, depending on the distance from the pivot shaft, the vibrations which are transmitted from the running thread to the thread sensor bar, are effective in an intensified degree in the range of this pivot shaft. The resulting increased load in the range of the pivot shaft leads to damages to the shaft bearings. This, in turn, is of negative influence on the sensitivity of response of the stop motion e.g. in case of a thread breakage. This may result in the fact that the thread sensor bar, upon the occurence of a thread breakage, is delayed in its pivotal downward movement under the force of gravity, from its operational position in which it is maintained by the running thread, to a lower position thereby releasing a signal or a control command for stopping the work station.

The vibrations which are transmitted from the running thread to the thread sensor bar can have an extremely negative effect in case of a two-for-one twisting spindle in which the stop motion forms the thread guide eyelet defining the apex of the thread balloon. The momenta originating from the thread balloon act in axial direction of the balloon as well as perpendicularly thereto. Depending on the length of the thread sensor bar, they are transmitted to the pivot shaft bearings in an intensified degree.

SUMMARY OF THE INVENTION

The object of the invention is to improve a stop motion of the kind described above in such a way that the vibrational momenta, which are transmitted from the running thread to the thread sensor bar, are absorbed to such an extent that, in the range of the pivot shaft bearings, the existing forces are almost about nil in order to obtain substantial protection of the bearings against damages and the disadvantageous consequences resulting therefrom.

For solving the aforementioned problem, the novel stop motion is characterized by a guide element located between the pivot shaft and the thread guide eyelet, said guide element supporting the thread sensor bar in upward direction and against lateral vibrational movements.

In this way, the vibrational momenta coming from the thread balloon are absorbed by the guide element in front of the pivot shaft so that the shaft bearings are intensively protected against wear due to vibration.

In order to bring the pivot shaft of the thread sensor bar as close as possible to the thread guide eyelet, according to a further feature of the invention, the pivot shaft is journalled in a holding member secured to a holding rod and supporting the guide element, said holding rod being adapted to be secured to the machine frame.

Preferably, the guide element is exchangeably secured to the holding member. By exchanging the guide element, a damage and a resultant inaccuracy in the response of the stop motion can be counteracted also in view of processing yarns of different qualities.

Preferably, the holding member is in the form of a substantially shuttle-shaped housing provided with a removable cover lid in order to protect, as far as possible, the switching and actuating elements and also the pivot shaft of the stop motion, against external influences, particularly dust and fluff.

Preferably, the thread sensor bar is likewise exchangeably inserted in a swivel member which is pivotable about the pivot shaft so that the thread guide eyelet can also be exchanged in view of yarns of different qualities and of possible damages in the range of the thread guide eyelet.

Preferably, the thread sensor bar forms the first arm of a two-armed lever pivotable about the pivot shaft and including the swivel member whereby the second arm serves, on the other hand, for initiating the function of pneumatical, electrical or electro-magnetical and/or mechanical switching or actuating elements which are provided in the range of the holding member and are responsive to pivotal movements of the thread sensor bar.

The holding rod which carries the holding member and is adapted to be secured to the machine frame, is preferably formed as an air duct opening into a pressure nozzle within the housing forming the holding member. Preferably, in such embodiment, a swivel plate is arranged opposite to the free end of the second arm of the two-armed lever, said swivel plate supporting a sealing member for closing the pressure nozzle which is assigned to a switching mechanism for machine components adapted to be controlled by the stop motion.

Preferably, the guide element is arranged closely adjacent to the thread guide eyelet so that, in consequence of the reduced length of the lever arm between the thread guide eyelet and the guide element, the load acting on the latter is reduced as far as possible.

Preferably, the guide element is provided with a groove tapering from bottom to top, the width of said groove being adapted to the width of the thread sensor bar so that the latter, in its operational position with normally running thread, is supported against lateral and upwardly directed vibrational movements.

A further preferred embodiment of the invention is characterized by exchangeable bearing rings slipped on the pivot shaft and received in bearing seats.

BRIEF DESCRIPTION OF THE DRAWINGS

The invention will be further described, by way of example, with reference to the accompanying drawings in which.

DETAILED DESCRIPTION OF THE INVENTION

Figure 4:
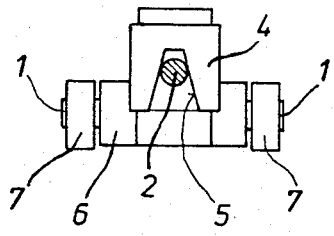
FIG. 4 is a sectional view in the direction of the arrow IV—IV showing only the guide element and the swivel member carrying the thread sensor bar, together with the pivot shaft and the exchangeable bearing rings.

The stop motion according to the invention comprises, as its essential components, a thread sensor bar 2 integral with a thread guide eyelet 3 which is formed as a pig tail, said thread sensor bar being pivotable about a pivot shaft 1, as well as a guide element 4 located between the pivot shaft 1 and the thread guide eyelet 3, and being provided with a groove 5 tapering from bottom to top. When the thread guide eyelet 3 and the thread sensor bar 2 occupy the position which is especially shown in FIGS. 1 and 4 and corresponds to the operational position with normally running thread, the thread sensor bar 2 is supported against lateral and upwardly directed movements by the side faces of the prism-shaped groove 5 tapering from bottom to top. In this way, the vibrational movements which are transmitted from a running thread to the thread guide eyelet 3 and, thus, to the thread sensor bar 2, are prevented from passing over to the pivot shaft 1 and its bearings, i.e., the vibrational movements acting on the pivot shaft 1, are reduced to a minimum value.

The thread sensor bar 2 is exchangeable and is inserted in a swivel member 6 pivotable about the pivot shaft 1, and is fastened therein e.g. by a screw (not shown), said swivel member 6 being substantially in the form of a two-armed lever, whereby the thread sensor bar 2 forms an extension of one of the lever arms. The pivot shaft 1 is inserted in the swivel member 6, and the bearing rings 7 are exchangeably slipped on the outwardly protruding ends of the pivot shaft 1.

Figure 2:
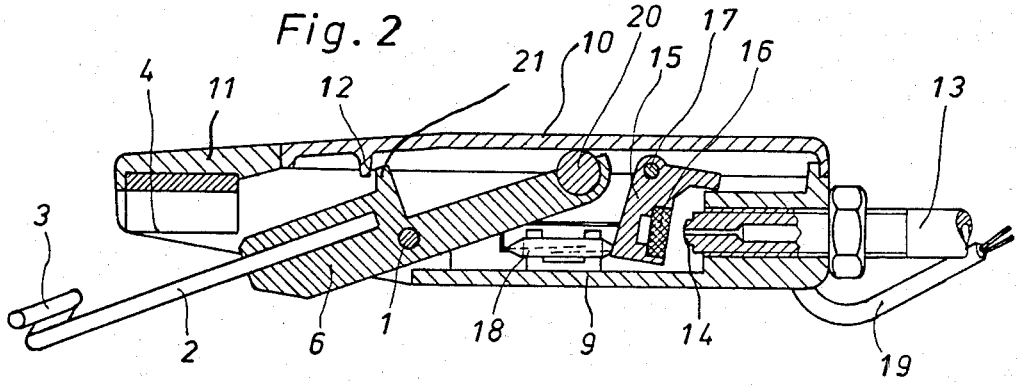
FIG. 2 is a sectional view corresponding to that of FIG. 1 with the thread guide eyelet pivoted downwardly (e.g. in case of a thread breakage)
Figure 3:
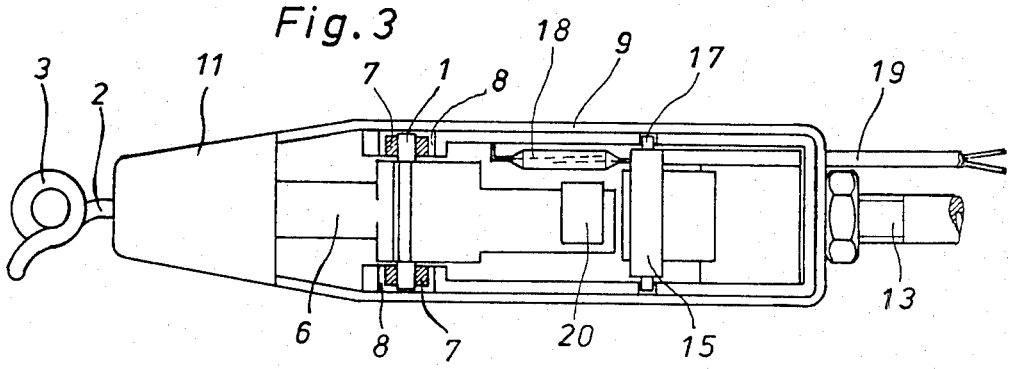
FIG. 3 is a plan view of the stop motion according to the invention with the cover lid removed from the housing forming the holding member.

The swivel member 6 is journalled, by means of bearing seats 8, in a substantially shuttle-shaped housing 9 forming a holding member, which housing is adapted to be closed against the environment by means of a cover lid 10. At its front end, the housing 9 is provided with an upper extension bonnet 11 into which the guide element 4 with its prism-shaped groove 5 facing downwardly, is exchangeably inserted and fastened therein e.g. by means of a screw (not shown). The cover lid 10 is fastened to the housing 9 in a manner not shown by means of a snap lock and is provided, on its underside, with a stop member 12 in order to limit the downwardly directed pivotal movement of the swivel member 6 as shown in FIG. 2. For this reason, swivel member 6 is likewise provided with a stop member 21.

The housing 9 is secured to a holding rod which is in the form of an air duct 13 by means of which the stop motion, as a whole, can be attached to the frame of a textile machine (not shown). The air duct 13 is adapted to be connected to a compressed-air source in the range of the machine frame.

Figure 1:
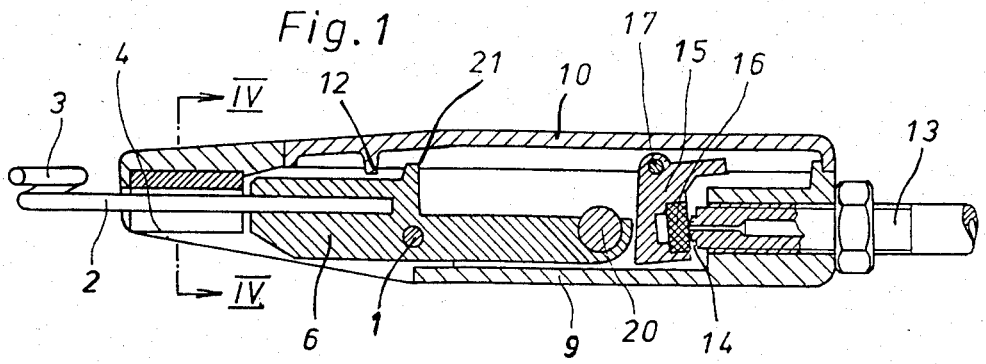
FIG. 1 is an axial section of the stop motion according to the invention with the thread guide eyelet occupying its operational position (with normally running thread)

The front end of the air duct 13 which extends into the housing 9, is formed as a pressure nozzle 14, the opening of which, in the position shown in FIG. 1, is closed by a swivel plate 15 carrying a sealing member 16. As shown in FIG. 1, the swivel plate 15 and the sealing member 16, respectively, are urged to and maintained in a position in which the pressure nozzle 14 is closed, by the rear arm of the swivel member 6 which is formed as a two-armed lever. The rear arm of the swivel member 6 and the swivel plate 15 are designed and coordinated in such a way that the pivotal movement of the thread guide eyelet from the operational position shown in FIG. 1 in which the thread guide eyelet is retained by the running thread, to its lower position subsequent to a thread breakage, is not obstructed or impeded. With respect to the distribution of weight, the swivel plate 15 which is pivotable about the axis 17, is designed so that it swivels in clockwise direction under the force of gravity as long as it is not urged, by the rear end of the swivel member 6, to the position for closing the pressure nozzle 14. The opening of the latter is therefore cleared.

A reed contact 18 is provided in the range of the rear arm of swivel member 6 which reed contact is connected, through a cable 19, to switching or actuating elements which are located e.g. in the area of the machine frame.

In order to actuate the reed contact 18, the rear arm of swivel member 6 carries a permanent magnet 20 which is positioned so that, depending on the pivotal position of the swivel member 6, the reed contact 18 is either opened or closed by means of said permanent magnet 20.

When the thread guide eyelet 3 occupies the operational position shown in FIG. 1, the pressure nozzle 14 is closed by the sealing member 16 which is inserted in the swivel plate 15, and the reed contact 18 is also closed. In this way, corresponding pneumatically and electrically controllable actuating elements are positioned or influenced in a manner which corresponds to the normal operation of the working station fitted with the stop motion according to the invention.

In case of a thread breakage or a used-up supply bobbin, the thread guide eyelet 3 tilts into the position shown in FIG. 2 since it is no longer supported by the thread whereby, on one hand, the opening of the pressure nozzle 14 is cleared in consequence of a pivotal movement of swivel plate 15 and the sealing member 16 associated therewith and whereby, on the other hand, the reed contact 18 is also opened. The resulting pressure-drop within the air duct 13 as well as the opening of the reed contact 19 result in the activation of succeeding control or actuating mechanisms so that the latter can take up their function and provide e.g. for the stoppage of the working station of the textile machine which is fitted with the stop motion.

In consequence of the pneumatical operation of the stop motion, compressed air will escape from the pressure nozzle 14 into the interior of the housing 9 upon any switching operation. Therefore, an excess pressure will forcibly build up in the housing. This excess pressure can escape only through the gap between the movable and stationary components of the entire stop motion which gap is due to construction. However, the escaping air will provide for the cleaning of the interior of the housing since any dust which has possibly been accumulated within the gap, will be prevented by the excess pressure from further penetrating into the housing.

In the drawings and specification there has been set forth a preferred embodiment of the invention and although specific terms are employed, they are used in a generic and descriptive sense only and not for purposes of limitation.

What is claimed is:

1. A stop motion mechanism for a textile machine for transmitting a signal to stop a work station in the event of thread breakage or exhaustion and comprising a thread sensor bar, a thread guide eyelet secured to one end of said thread sensor bar for receiving a running thread therethrough, means pivotally mounting said thread sensor bar for movement between a first position occupied when the thread is running normally through said thread guide eyelet and a second position occupied when the thread breaks or exhausts, means responsive to said thread sensor bar occupying said second position for transmitting the signal, and guide means positioned between said thread guide eyelet and said pivotal mounting means for said thread sensor bar for receiving said thread sensor bar when it occupies its first position and for supporting said thread sensor bar against lateral vibrational movements caused by the running thread.

2. A stop motion mechanism, as set forth in claim 1, in which said means pivotally mounting said thread sensor bar includes a shaft, and in which said stop motion mechanism further includes a holding member receiving said shaft in journalled relationship, a holding rod secured to said holding member and adapted to be secured to the textile machine for supporting said stop motion mechanism.

3. A stop motion mechanism, as set forth in claim 2, in which said guide means comprises a separate member exchangeably secured to said holding member.

4. A stop motion mechanism, as set forth in claim 2 or 3, in which said holding member comprises a hollow, substantially shuttle-shaped housing defining a closed interior and including a removable cover lid.

5. A stop motion mechanism, as set forth in claim 4, in which said means for transmitting the signal comprises a device selected from the group consisting of pneumatic, electrical, mechanical or electro-mechanical devices.

6. A stop motion mechanism, as set forth in claim 4, in which said means pivotally mounting said thread sensor bar further includes a swivel member exchangeably receiving said pivot shaft.

7. A stop motion mechanism, as set forth in claim 6, in which said thread sensor bar and said swivel member form a two-armed lever pivotable about said pivot shaft, and in which said thread sensor bar is part of the first arm of said two-armed lever.

8. A stop motion mechanism, as set forth in claim 7, in which said means for transmitting the signal comprises a pneumatic device including a pressure nozzle opening into said housing, and a swivel plate movably mounted opposite the second arm of said two-armed lever and responsive to movement of said two-armed lever and having a sealing member thereon for movement into engagement with and closing said pressure nozzle when said thread sensor bar is in its first position.

9. A stop motion mechanism, as set forth in claim 8, in which said holding rod comprises an air duct connected to said pressure nozzle.

10. A stop motion mechanism, as set forth in claim 4, in which said housing includes bearing seats for the ends of said pivot shaft, and in which bearing rings are positioned on the end of said pivot shaft for being received in said bearing seats.

11. A stop motion mechanism, as set forth in claim 1, 2 or 3, in which said guide means includes a groove tapering from the outside to the inside of said guide means.

* * * * *